US007562401B2

(12) United States Patent
Kim et al.

(10) Patent No.: US 7,562,401 B2
(45) Date of Patent: Jul. 21, 2009

(54) WAKEBOARD-ONLY ARTIFICIAL POOL SYSTEM

(75) Inventors: Jung-Han Kim, Incheon (KR); Jung-Sik Lee, Seoul (KR)

(73) Assignee: Semyung Ind. Machinary, Co., Ltd. (KR)

( * ) Notice: Subject to any disclaimer, the term of this patent is extended or adjusted under 35 U.S.C. 154(b) by 0 days.

(21) Appl. No.: 12/070,636

(22) Filed: Feb. 20, 2008

(65) Prior Publication Data

US 2009/0133187 A1 May 28, 2009

(30) Foreign Application Priority Data

Nov. 27, 2007 (KR) ..... 10-2007-0121347

(51) Int. Cl.
*A47K 3/10* (2006.01)

(52) U.S. Cl. ..... 4/491

(58) Field of Classification Search ..... 4/491, 4/488

See application file for complete search history.

(56) References Cited

U.S. PATENT DOCUMENTS 5,298,003 A * 3/1994 Weihe et al. ..... 482/55

5,662,558 A * 9/1997 Shannon, III ..... 482/55

* cited by examiner

*Primary Examiner*—Huyen Le
(74) *Attorney, Agent, or Firm*—Galgano & Associates, PLLC

(57) ABSTRACT

Disclosed herein is a wakeboard-only artificial pool system. The system includes an artificial pool. A model boat is installed at a front position in the artificial pool and is rotatably coupled at a lower end and both sides thereof to support members such that an inclination of the model boat can be adjusted and the adjusted angle can be maintained, while the model boat is supported during wakeboarding. A high-speed injection means produces a wake under the lower portion of the model boat as if water were colliding with the front of the operating model boat, and sprays water on the lower end of a bow of the model boat at high speed, thus creating a current on the surface of the artificial pool so as to help a user float on water. A circulation means circulates water fed into and discharged from the artificial pool. A wake size/shape adjusting means is mounted to the model boat and rotated by power generated when the model boat is operating, thus creating a water current and adjusting the size and shape of the wake. A wake attenuating means is mounted to the inner wall of the artificial pool, and attenuates waves generated when the wake produced during wakeboarding is reflected from a wall.

13 Claims, 7 Drawing Sheets

WAKEBOARD-ONLY ARTIFICIAL POOL SYSTEM

BACKGROUND OF THE INVENTION

1. Field of the Invention

The present invention relates generally to a wakeboard-only artificial pool system and, more particularly, to a wakeboard-only artificial pool system, in which an artificial pool having essential elements that are required to ride a wakeboard is installed indoors or outdoors, thus allowing a user to always enjoy wakeboarding using a wake which is produced artificially, regardless of various conditions, place, and time.

2. Description of the Related Art

Generally, wakeboarding is a kind of boarding in which one rides over water, and is a water sport which has rapidly spread in recent years and appeals to young people. A wake designates a V-shaped pair of traces in water which is created behind a boat by the rotation of a propeller which is installed in the boat. Wakeboarding is characterized in that a rider can easily enjoy various thrilling actions by jumping and spinning over water using the wake.

However, in order to ride the wakeboard, a place having a large water surface on which a boat may move at high speed, for example, the sea, a river, a reservoir, or a lake, a wakeboard-only boat which produces the wake and has high horsepower, and a skilled boat driver are essentially required. Further, restrictions for preventing environmental pollution must be considered, and a transportation means is required in order to move to the place. In addition, various natural restrictions, including seasonal or geographical factors, temperature, and climate, are imposed. Only when these requirements are satisfied, a user can ride the wakeboard. Thus, there has been a demand for an artificial pool which allows a rider to enjoy wakeboarding anytime, regardless of the above-mentioned requirements, place, and time.

SUMMARY OF THE INVENTION

Accordingly, the present invention has been made keeping in mind the above problems occurring in the prior art, and an object of the present invention is to provide a wakeboard-only artificial pool system, in which an artificial pool having essential elements that are required to ride a wakeboard is installed indoors or outdoors, thus allowing a user to always enjoy wakeboarding using a wake which is produced artificially, regardless of various conditions, place, and time, therefore satisfying his or her demand, in addition to allowing him or her to safely and conveniently enjoy wakeboarding.

Another object of the present invention is to provide a wakeboard-only artificial pool system, which leads to the popularization of wakeboarding, thus arousing interest in wakeboarding, therefore remarkably increasing the number of people who enjoy wakeboarding.

In order to accomplish the above objects, the present invention provides a wakeboard-only artificial pool system, including an artificial pool which is used for wakeboarding, a model boat which is installed at a front position in the artificial pool and is rotatably coupled at a lower end and both sides thereof to support members such that an inclination of the model boat is adjusted and an adjusted angle is maintained, while the model boat is supported during wakeboarding, a high-speed injection means for producing a wake at a lower end of the model boat as if water were colliding with a front of the model boat when operating, and spraying water on a lower end of a bow of the model boat at high speed, thus creating a current on a surface of the artificial pool so as to help a user to float on water, a circulation means for circulating water which is fed into and discharged from the artificial pool, a wake size/shape adjusting means mounted to the model boat, and rotated by power generated when the model boat is operating, thus creating a water current, and adjusting a size and shape of the wake, and a wake attenuating means which is mounted to an inner wall of the artificial pool and attenuates waves generated when the wake produced during wakeboarding is reflected from a wall.

Further, an elastic member made of rubber or urethane is attached to a bottom in the artificial pool, and functions to prevent passage of water and mitigate shocks.

A mat filled with water is attached to the bottom in the artificial pool.

Further, a rope support pole is vertically installed at an upper end of the model boat, and functions to support an end of a rope which is grasped by the user during wakeboarding.

The high-speed injection means includes a main injection nozzle which is installed at a center of a front end of the artificial pool, and a plurality of subsidiary injection nozzles which are installed at the front end of the artificial pool in such a way as to be provided on opposite sides of the main injection nozzle, and spray water into the artificial pool together with the main injection nozzle.

The circulation means includes a circulation pipe which is installed outside the artificial pool to be positioned between the high-speed injection means and a drain hole, and serves as a channel for circulating water in the artificial pool, and a circulation pump which is mounted to the circulation pipe, and is operated to circulate water supplied to and discharged from the artificial pool.

The drain hole comprises a plurality of holes which are provided at a center on a rear end of the artificial pool and both sidewalls thereof.

The wake size/shape adjusting means includes a drive motor which is mounted to a lower portion of a rear of the model boat and generates power when wakeboarding, and a propeller which is mounted to an end of a motor shaft of the drive motor and is rotated by power transmitted from the drive motor.

The wake attenuating means includes a primary wake attenuating member which is provided in the artificial pool, and primarily absorbs and passes the wake, and a secondary wake attenuating member which is supported by a support member between the inner wall of the artificial pool and the primary wake attenuating member in such a way that an interval between the artificial pool and the primary wake attenuating member is adjusted, and secondarily absorbs the wake which has passed the primary wake attenuating member.

Further, the primary wake attenuating member comprises a grid net.

The secondary wake attenuating member comprises a sponge plate having an embossed shape.

Further, the artificial pool is installed outdoors or indoors.

BRIEF DESCRIPTION OF THE DRAWINGS

The above and other objects, features and advantages of the present invention will be more clearly understood from the following detailed description, taken in conjunction with the accompanying drawings, in which.

DESCRIPTION OF THE PREFERRED EMBODIMENTS

Figure 1:
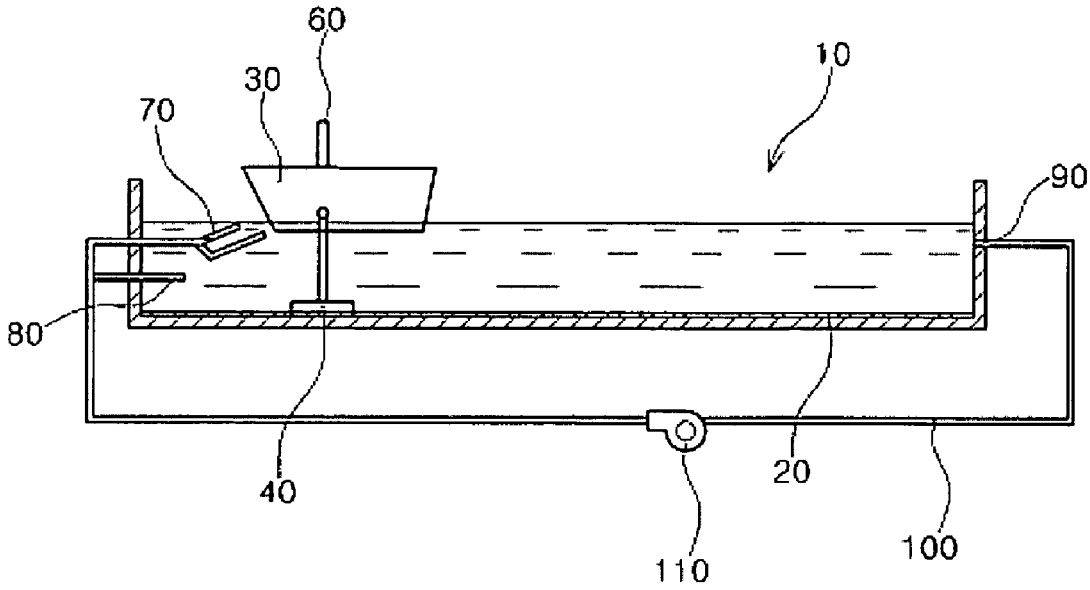
FIG. 1 is a vertical sectional view showing a wakeboard-only artificial pool system, according to the present invention.

Reference now should be made to the drawings, in which the same reference numerals are used throughout the different drawings to designate the same or similar components.

Figure 2:
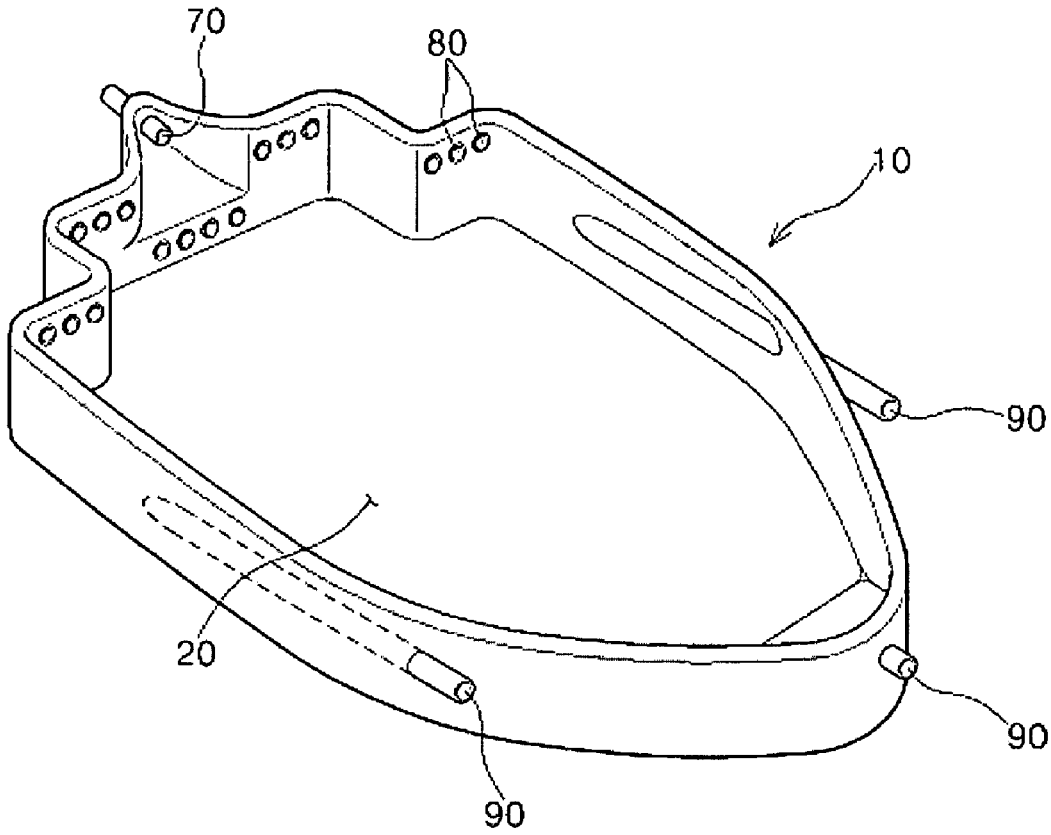
FIG. 2 is a perspective view showing an artificial pool, according to an embodiment of the present invention.
Figure 3:
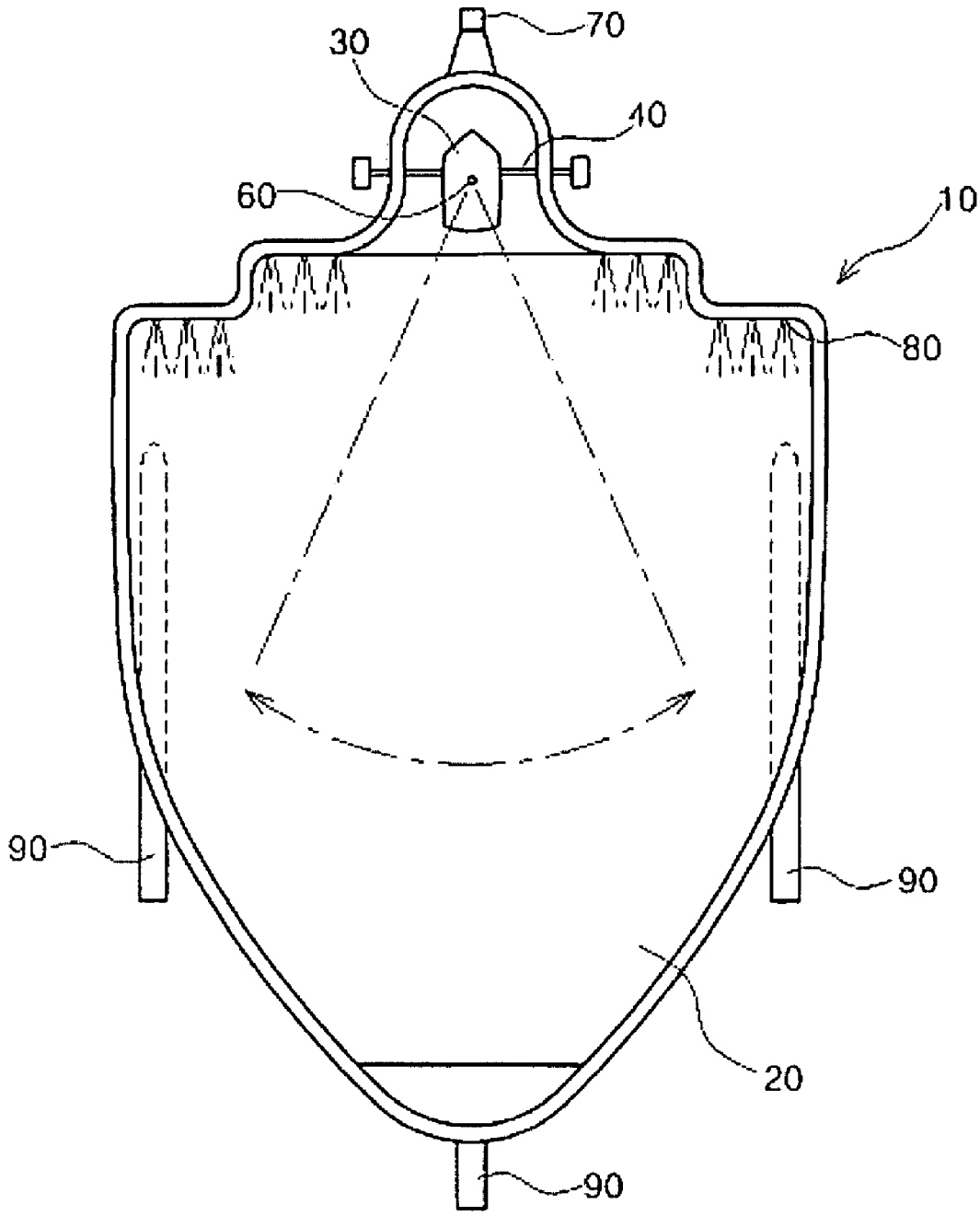
FIG. 3 is a plan view showing the artificial pool, according to the present invention.
Figure 4:
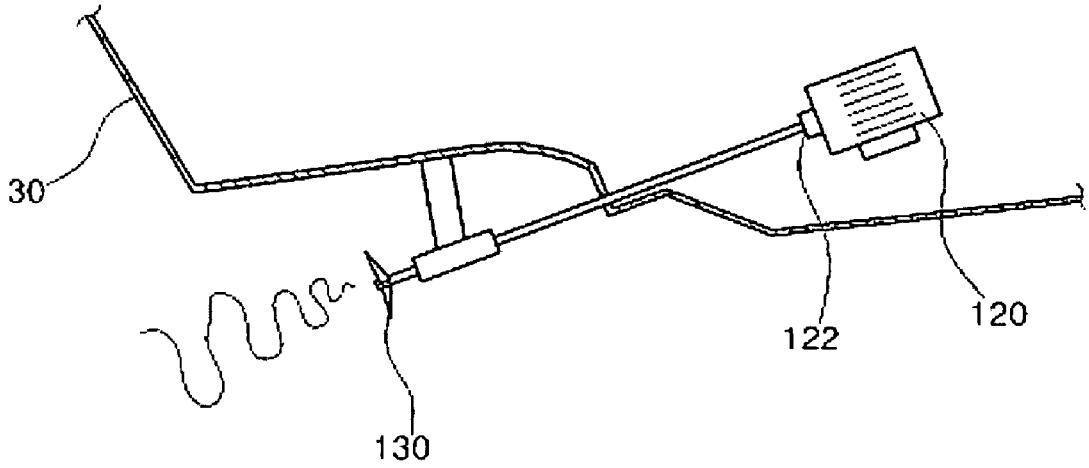
FIG. 4 is a side view showing the state in which a motor and a propeller are installed on the underside of a model boat according to the present invention.
Figure 5:
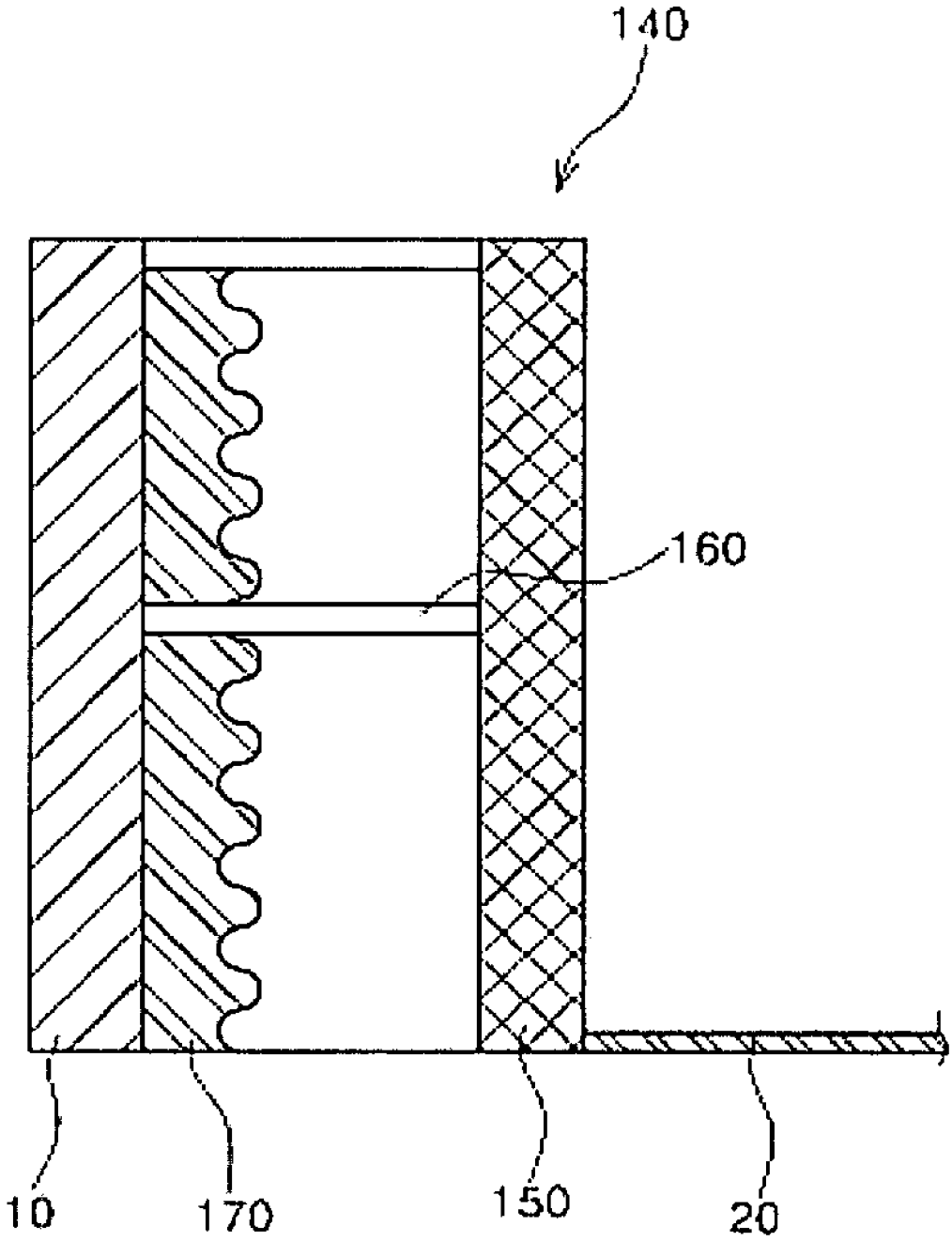
FIG. 5 is a vertical sectional view showing the state in which a wake attenuating means is mounted to the artificial pool according to the present invention.
Figure 6:
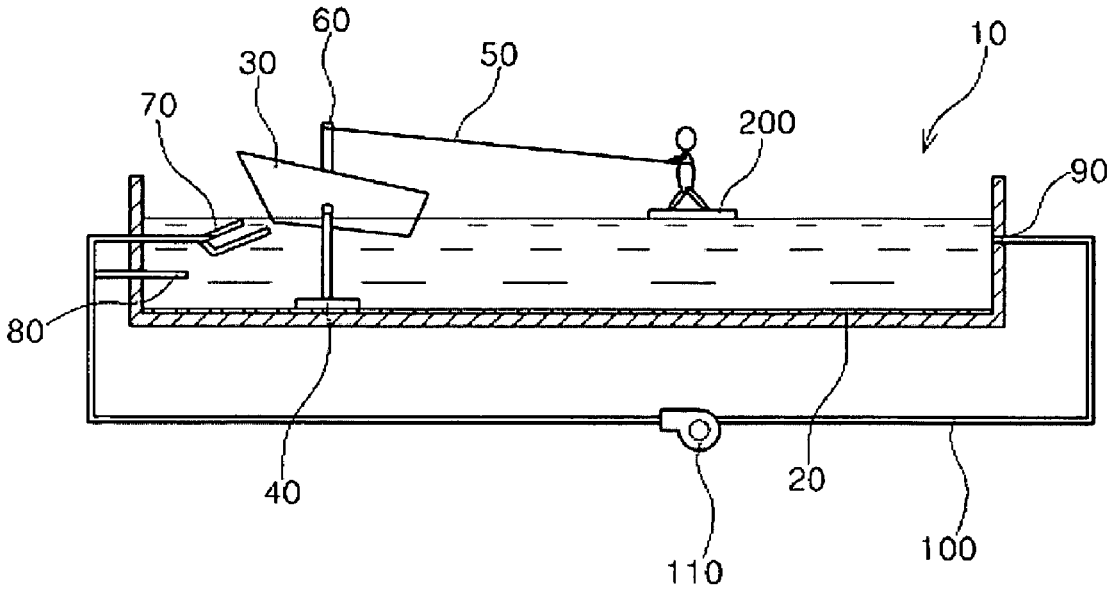
FIG. 6 is a vertical sectional view showing the operational state when wakeboarding in the wakeboard-only artificial pool, according to the present invention.

FIG. 1 is a vertical sectional view showing a wakeboard-only artificial pool system, according to the present invention, FIG. 2 is a perspective view showing an artificial pool, according to an embodiment of the present invention, FIG. 3 is a plan view showing the artificial pool, according to the present invention, FIG. 4 is a side view showing the state in which a motor and a propeller are installed on the underside of a model boat according to the present invention, FIG. 5 is a vertical sectional view showing the state in which a wake attenuating means is mounted to the artificial pool according to the present invention, and FIG. 6 is a vertical sectional view showing the operational state when wakeboarding in the wakeboard-only artificial pool, according to the present invention.

The wakeboard-only artificial pool system according to the present invention includes an artificial pool 10 which is installed indoors or outdoors and is used for wakeboarding. An elastic member 20 is attached to the bottom of the artificial pool 10 so as to provide a water-proof effect and mitigate shocks, and is made of rubber or urethane. A model boat 30 is rotatably coupled to the front portion of the artificial pool 10 by support members 40 such that the lower end and both sides of the model boat 30 are supported during wakeboarding, the inclination of the model boat 30 can be adjusted, and the adjusted angle can be maintained. A rope support pole 60 is vertically installed on the upper end of the model boat 30, and functions to support an end of a rope 50 that is held by a user while wakeboarding.

Further, a main injection nozzle 70 is installed at the center of the front end of the artificial pool 10. The main injection nozzle 70 produces a wake at the lower end of the model boat 30, thus providing the effect of causing water to collide with the front of the model boat 30, which is running during wakeboarding, and in addition, sprays water on the lower end of the bow of the model boat 30 at high speed, thus creating a current on the surface of the artificial pool 10, thereby helping a user who rides the wakeboard to float on the water. A plurality of subsidiary injection nozzles 80 is provided on the front end of the artificial pool 10 in such a way as to be located on opposite sides of the main injection nozzle 70, and functions to spray water into the artificial pool 10 together with the main injection nozzle 70.

Further, a plurality of drain holes 90 is formed in the center of the rear end of the artificial pool 10 and both sidewalls thereof, and is used to drain water from the artificial pool 10. A circulation pipe 100 is provided outside the artificial pool 10 in such a way as to be positioned between the main and subsidiary injection nozzles 70 and 80 and the drain holes 90, and serves as a water channel in which water contained in the artificial pool 10 circulates. A circulation pump 110 is mounted on the circulation pipe 100 and is operated to circulate water which is supplied to or discharged from the artificial pool 10.

A drive motor 120 is mounted to the lower portion of the rear of the model boat 30, and comprises an inverter motor which generates power during wakeboarding. A propeller 130 is mounted to an end of a motor shaft 122 of the drive motor 120, and is rotated by power transmitted from the drive motor 120, thus forming water current and adjusting the size and shape of the wake.

Further, a wake attenuating means 140 is mounted to the inner wall of the artificial pool 10, and functions to attenuate waves generated when the wake produced while wakeboarding is reflected on the wall. The wake attenuating means 140 includes a primary wake attenuating member 150 and a secondary wake attenuating member 170. The primary wake attenuating member 150 comprises a grid net which is secured to the interior of the artificial pool 10 and primarily absorbs and passes the wake. The secondary wake attenuating member 170 is supported by a support member 160 between the inner wall of the artificial pool 10 and the primary wake attenuating member 150 in such a way that the interval between the artificial pool 10 and the primary wake attenuating member 150 is adjusted. The secondary wake attenuating member 170 comprises a sponge plate having an embossed shape so as to secondarily absorb the wake which has passed the primary wake attenuating member 150.

The present invention, constructed as described above, is used as follows. That is, as shown in FIGS. 1 to 6, the wakeboard-only artificial pool 10 is installed at a predetermined place inside or outside a building. In such a state, when a user desires to go wakeboarding, the model boat 30 maintains a flat state if it stops, as shown in FIG. 1. Meanwhile, when the model boat 30 runs over water for wakeboarding, as shown in FIG. 6, a user who rides the wakeboard 200 holds the rope 50, an end of which is supported by the rope support pole 60 installed at the upper end of the model boat 30, with his or her hands. At this time, the bow of the model boat 30 rises, while the stern of the model boat 30 is lowered, so that the model boat 30 is inclined.

In such a state, the wake is produced at the lower end of the model boat 30 by the main injection nozzle 70, which is installed at the center of the front end of the artificial pool 10, as if water were colliding with the front of the model boat 30 which is running during wakeboarding. Further, in order to help a user who is wakeboarding to float on the water, the main injection nozzle 70 sprays water on the lower end of the bow of the model boat 30 at high speed, thus creating a current on the surface of the artificial pool 10.

Simultaneously, water is sprayed through the plurality of subsidiary injection nozzles 80, which are installed at the front end of the artificial pool 10 in such a way as to be provided on opposite sides of the main injection nozzle 70, at high speed. Further, the propeller 130, which is installed on the end of the motor shaft 122 of the drive motor 120, which is mounted to the lower portion of the rear of the model boat 30, is rotated by power transmitted from the drive motor 120, thus creating water current and adjusting the size and shape of the wake, therefore allowing the water in the artificial pool 10 to flow at high speed, that is, at a surface velocity of 30~50 km/hr. As a result, the model boat 30 is fixed at a position in such a way that it does not move forwards, but has the same effect as when a boat runs over the river or the sea.

Further, the wake produced during wakeboarding collides against the wall of the artificial pool 10 and is reflected therefrom, thus creating an opposite wave. The opposite wave is attenuated and dissipated by the wake attenuating means 140, which is mounted to the inner wall of the artificial pool 10. The attenuation process of the wake is as follows. First, the primary wake attenuating member 150, comprising the grid net, which is secured to the interior of the artificial pool 10, primarily absorbs and passes the wake. The secondary wake attenuating member 170, which comprises the sponge plate having the embossed shape and is supported by the support member 160 between the inner wall of the artificial pool 10 and the primary wake attenuating member 150 in such a way that an interval between the artificial pool 10 and the primary wake attenuating member 150 is adjusted, secondarily absorbs the wake which has passed the primary wake attenuating member 150. Subsequently, the wake is discharged through the drain holes 90 which are formed in both sidewalls of the rear of the artificial pool 10. In this way, the produced wake is attenuated and is efficiently dissipated.

The remaining wake, which is not discharged completely through the drain holes 90, is reflected again, and collides with the secondary and primary wake attenuating members 170 and 150, so that the wake is attenuated and thus completely dissipated.

Further, water fed into the artificial pool 10 is discharged through the plurality of drain holes 90 which are formed in the center of the rear end of the artificial pool 10 and both sidewalls thereof. The water circulates through the circulation pipe 100 which is installed outside the artificial pool 10 in such a way as to be positioned between the main and subsidiary injection nozzles 70 and 80 and the drain holes 90 and to communicate with the main and subsidiary injection nozzles 70 and 80 and the drain holes 90. By the operation of the circulation pump 110, which is mounted to the circulation pipe 100, water to be supplied to or discharged from the artificial pool 10 can circulate smoothly.

Further, in the wakeboard-only artificial pool system of the present invention, the shape of the artificial pool 10 is not limited to the shape shown in the drawings, but may be variously changed. Further, according to the ability of a user who is wakeboarding, the size and shape of the wake and the surface velocity in the artificial pool 10 may be controlled as desired.

Figure 7:
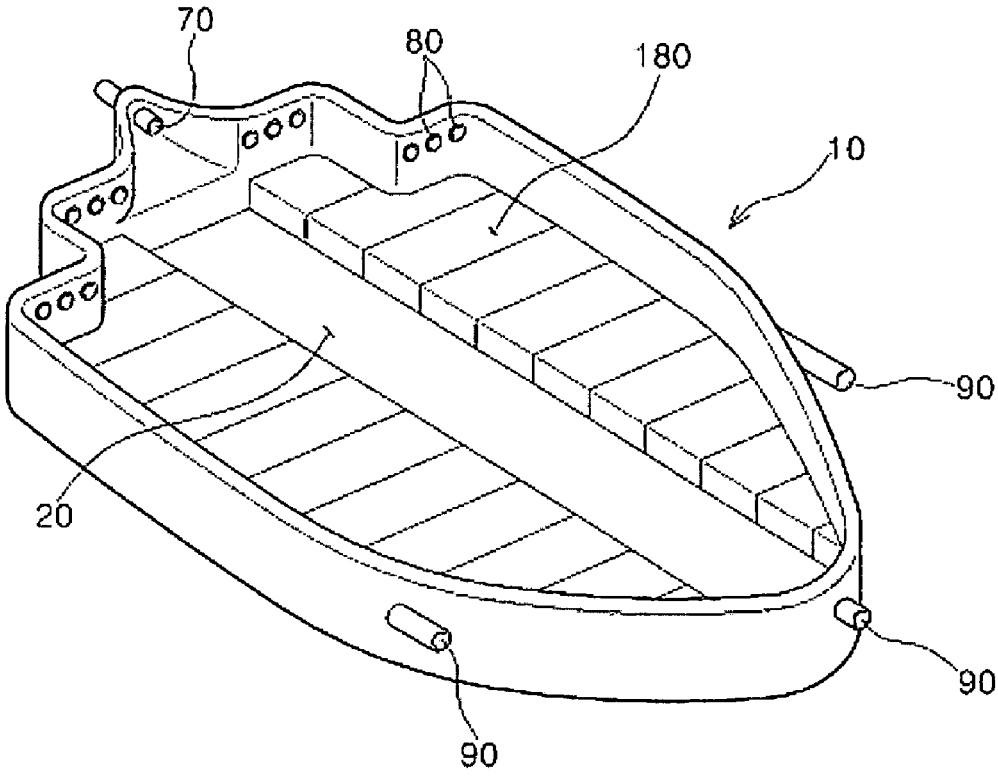
FIG. 7 is a perspective view showing an artificial pool according to another embodiment of the present invention.

FIG. 7 shows another embodiment of the present invention. As shown in the drawing, in place of attaching the elastic member 20 made of rubber or urethane to the bottom in the artificial pool 10, mats 180 filled with water are attached to both sides of the bottom in the artificial pool 10. In this case, the height of each mat 180 is half that of the artificial pool 10. The mats 180 provide a shock-absorbing effect, and in addition, achieve the same effect even when a smaller amount of water is fed into the artificial pool 10.

As described above, the present invention provides a wakeboard-only artificial pool system, in which an artificial pool having essential elements that are required to ride a wakeboard is installed indoors or outdoors, thus allowing a user to always enjoy wakeboarding using a wake which is produced artificially, regardless of various conditions, including the winter season, the rainy season, and nighttime, place, or time, therefore remarkably reducing the time and cost required to move to a wakeboarding location. Further, the present invention allows a user to repeatedly practice the same pattern until he or she is accustomed to riding the wakeboard, thus maximizing the training effect, and can be used by a skillful user as well as a beginner, thus satisfying various users' demands, and allows a user to enjoy wakeboarding safely and conveniently. Furthermore, the present invention leads to the popularization of wakeboarding, thus arousing interest in wakeboarding, therefore remarkably increasing the number of people who enjoy wakeboarding.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wakeboard-only artificial pool system, comprising:

an artificial pool used for wakeboarding;

a model boat installed at a front position in the artificial pool, and rotatably coupled at a lower end and both sides thereof to support members such that an inclination of the model boat is adjusted and an adjusted angle is maintained, while the model boat is supported during wakeboarding;

high-speed injection means for producing a wake at a lower end of the model boat as if water were colliding with a front of the model boat when operating, and spraying water on a lower end of a bow of the model boat at high speed, thus creating a current on a surface of the artificial pool so as to help a user to float on water;

circulation means for circulating water which is fed into and discharged from the artificial pool;

wake size/shape adjusting means mounted to the model boat, and rotated by power generated when the model boat is operating, thus creating a water current, and adjusting a size and shape of the wake; and wake attenuating means mounted to an inner wall of the artificial pool, and attenuating waves generated when the wake produced during wakeboarding is reflected from a wall.

2. The wakeboard-only artificial pool system as set forth in claim 1, wherein an elastic member made of rubber or urethane is attached to a bottom in the artificial pool, and functions to prevent passage of water and mitigate shocks.

3. The wakeboard-only artificial pool system as set forth in claim 1, wherein a mat filled with water is attached to the bottom in the artificial pool.

4. The wakeboard-only artificial pool system as set forth in claim 1, wherein a rope support pole is vertically installed at an upper end of the model boat, and functions to support an end of a rope which is grasped by the user during wakeboarding.

5. The wakeboard-only artificial pool system as set forth in claim 1, wherein the high-speed injection means comprises:

a main injection nozzle installed at a center of a front end of the artificial pool; and a plurality of subsidiary injection nozzles installed at the front end of the artificial pool in such a way as to be provided on opposite sides of the main injection nozzle, and spraying water into the artificial pool together with the main injection nozzle.

6. The wakeboard-only artificial pool system as set forth in claim 1, wherein the circulation means comprises:

a circulation pipe installed outside the artificial pool to be positioned between the high-speed injection means and a drain hole, and serving as a channel for circulating water in the artificial pool; and a circulation pump mounted to the circulation pipe, and operated to circulate water which is supplied to and discharged from the artificial pool.

7. The wakeboard-only artificial pool system as set forth in claim 6, wherein the drain hole comprises a plurality of holes which are provided at a center on a rear end of the artificial pool and both sidewalls thereof.

8. The wakeboard-only artificial pool system as set forth in claim 1, wherein the drain hole comprises a plurality of holes which are provided at a center on a rear end of the artificial pool and both sidewalls thereof.

9. The wakeboard-only artificial pool system as set forth in claim 1, wherein the wake size/shape adjusting means comprises:

a drive motor mounted to a lower portion of a rear of the model boat, and generating power when wakeboarding; and a propeller mounted to an end of a motor shaft of the drive motor, and rotated by power transmitted from the drive motor.

10. The wakeboard-only artificial pool system as set forth in claim 1, wherein the wake attenuating means comprises:

a primary wake attenuating member provided in the artificial pool, and primarily absorbing and passing the wake; and a secondary wake attenuating member supported by a support member between the inner wall of the artificial pool and the primary wake attenuating member in such a way that an interval between the artificial pool and the primary wake attenuating member is adjusted, and secondarily absorbing the wake which has passed the primary wake attenuating member.

11. The wakeboard-only artificial pool system as set forth in claim 10, wherein the primary wake attenuating member comprises a grid net.

12. The wakeboard-only artificial pool system as set forth in claim 10, wherein the secondary wake attenuating member comprises a sponge plate having an embossed shape.

13. The wakeboard-only artificial pool system as set forth in claim 1, wherein the artificial pool is installed outdoors or indoors.

* * * * *